US008107648B2

(12) United States Patent
Nakatani

(10) Patent No.: US 8,107,648 B2
(45) Date of Patent: Jan. 31, 2012

(54) BONE CONDUCTION EARPHONE

(75) Inventor: Hidenori Nakatani, Osaka (JP)

(73) Assignee: Cosmogear Co., Ltd., Osaka-shi (JP)

( * ) Notice: Subject to any disclaimer, the term of this patent is extended or adjusted under 35 U.S.C. 154(b) by 909 days.

(21) Appl. No.: 12/155,510

(22) Filed: Jun. 5, 2008

(65) Prior Publication Data

US 2009/0304209 A1 Dec. 10, 2009

(51) Int. Cl.
*H04R 25/00* (2006.01)

(52) U.S. Cl. ..... 381/151; 381/380

(58) Field of Classification Search ..... 381/151, 381/369, 174, 178, 370, 396, 400, 412
See application file for complete search history.

(56) References Cited

U.S. PATENT DOCUMENTS

2007/0121983 A1 * 5/2007 Jayanth et al. ..... 381/345

FOREIGN PATENT DOCUMENTS

| | | |
|---|---|---|
| JP | 2002-273343 | 9/2002 |
| JP | 2003-274467 | 9/2003 |
| JP | 2006-033787 | 2/2006 |
| JP | 2006-174432 | 6/2006 |
| WO | WO 99/09785 | 2/1999 |
| WO | WO 02/19759 | 3/2002 |

* cited by examiner

*Primary Examiner* — Tuan Nguyen
(74) *Attorney, Agent, or Firm* — Kratz, Quintos & Hanson, LLP

(57) ABSTRACT

A bone conduction earphone in which a large magnetic force can be generated and which can achieve improvement of sound quality and reduction of power consumption is provided. A vibration part 3 is provided to include a first magnet 32 and a second magnet 34, which coaxially secure a voice coil 2 on an inner surface 12*a* of an upper wall 12 of a cylinder-shaped frame 10 having an open lower part and are located in an inner side region and an outer side region of the voice coil 2, and a diaphragm 36 which connects the first magnet 32 and the second magnet 34 to the frame 10. A vibration transmission cushion 5 is provided to a lower part of the frame 10 in order to transmit a vibration of the voice coil 2 and the vibration part 3 to a human body.

12 Claims, 4 Drawing Sheets

BONE CONDUCTION EARPHONE

BACKGROUND OF THE INVENTION

1. Field of the Invention

The present invention relates to a bone conduction earphone, and more specifically relates to a bone conduction earphone which can quickly and accurately reflect a small change of electric current in a bone conducted vibration.

2. Description of the Background Art

Normally, a vibration of sound conducted through air is transmitted to an eardrum inside an ear. There are three bones (ossicles) inside the eardrum, and a vibration of the eardrum is transmitted to a screw-like cochlea via the bones. The cochlea contains lymph, and a vibration of the lymph is transmitted to the auditory nerve as electric signals, whereby a brain recognizes the sound. On the other hand, in a bone conduction, the process of the vibration travelling through the eardrum and the ossicles in the mechanism described above is omitted. That is, the vibration of sound is directly sent to the cochlea via a skull, whereby even a hearing-impaired person and the like having an abnormality in the eardrum or ossicles can reliably hear the sound by the bone conduction as long as the cochlea and the auditory nerve are normal. An earphone applying this principle is the bone conduction earphone.

Various types and forms of bone conduction earphones have been conventionally developed. Most of them are configured of a frame, a voice coil, a magnet, a diaphragm, and the like, and have a structure in which the magnet is arranged in either an inner side region or an outer side region of the voice coil (for example, see Patent Document 1). However, magnetic forces generated by the conventional bone conduction earphones are limited, whereby a quick and accurate response cannot be expected unless an accordingly large amount of electric current is supplied to the voice coil. Thus, there have been limits to improving sound quality and reducing power consumption of audio devices.

Patent Document 1: Japanese Unexamined Patent Publication No. 2006-174432

Patent Document 2: Japanese Unexamined Patent Publication No. 2006-33787

SUMMARY OF THE INVENTION

The present invention has been made in view of the circumstances described above, and has an object of providing a bone conduction earphone in which a large magnetic force can be generated and which can achieve improvement of sound quality and reduction of power consumption.

In order to solve the problem described above, a bone conduction earphone of the present invention is configured to include a vibration part including a first magnet and a second magnet which coaxially secure a voice coil on an inner surface of an upper wall of a cylinder-shaped frame having an open lower part and are located in an inner side region and an outer side region of the voice coil, and a diaphragm which connects the first magnet and the second magnet to the frame, and a vibration transmission cushion provided to the lower part of the frame in order to transmit a vibration of the voice coil and the vibration part to a human body.

It is preferable that the vibration part be configured with the first magnet and the second magnet arranged on an upper surface of a substrate attached on a center of the diaphragm as a yoke, a first plate provided on an upper surface of the first magnet, a second plate provided on an upper surface of the second magnet, and the voice coil located in a gap between the first and second plates.

It is particularly preferable that through holes continuous with each other be provided in respective center positions of the diaphragm, the substrate, the first magnet, and the first plate, and that the respective members be integrally connected by a securing pin penetrating the through holes.

It is also preferable that the diaphragm be configured with a center part attached to the substrate, a peripheral part attached to the frame, and a plurality of connection parts provided radially between the center part and the peripheral part, and that the connection part be formed with a bend part bended in a crinkled or wrinkled manner.

It is further preferable that a cap which closes the lower part of the frame be provided in a state where the cap is in contact with the diaphragm to be connected to the frame, and that the vibration transmission cushion be provided on a lower surface of the cap.

With the bone conduction earphone of the present invention described above, the magnets are arranged respectively on the inner side and the outer side of the voice coil, whereby the magnetic force is remarkably strengthened, enabling a quick response to a small change of electric current supplied to the voice coil. Accordingly, improvement of sound quality and reduction of current consumption ratio can be achieved.

Specifically, since the vibration part is configured with the first magnet and the second magnet arranged on the upper surface of the substrate attached on the center of the diaphragm as the yoke, the first plate provided on the upper surface of the first magnet, the second plate provided on the upper surface of the second magnet, and the voice coil located in the gap between the first and second plates, an efficient magnetic circuit can be formed by the two magnets.

Since the through holes continuous with each other are provided in the respective center positions of the diaphragm, the substrate, the first magnet, and the first plate, and the respective members are integrally connected by the securing pin penetrating the through holes, the structure is simplified, whereby reduction of manufacturing cost can be achieved.

Since the diaphragm is configured with the center part attached to the substrate, the peripheral part attached to the frame, and the plurality of connection parts provided radially between the center part and the peripheral part, and the connection part is formed with a bend part bended in a crinkled or wrinkled manner, a relative vibration generated in the magnet is smoothly transmitted to the frame and a surface area contributing to the vibration increases due to the existence of the bend part, whereby the vibration is transmitted smoothly and a vibration efficiency is improved.

Since the cap which closes the lower part of the frame is provided in the state where the diaphragm to be connected to the frame is in contact, and the vibration transmission cushion is provided on the lower surface of the cap, the vibration can be more directly transmitted to the vibration transmission cushion, whereby the bone conduction efficiency can be improved.

DESCRIPTION OF THE PREFERRED EMBODIMENTS

Figure 1:
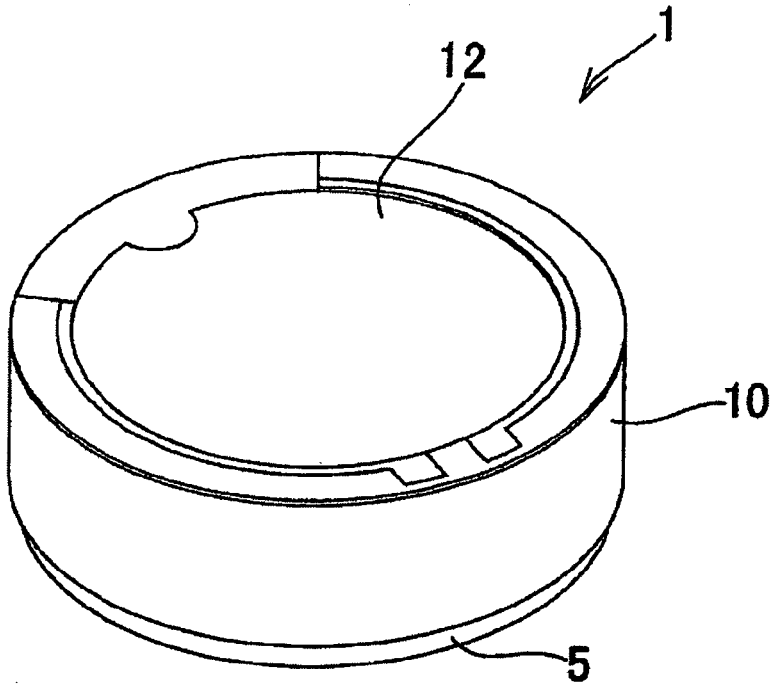
FIG. 1 is an upper perspective view showing a bone conduction earphone according to a representative embodiment of the present invention.
Figure 2:
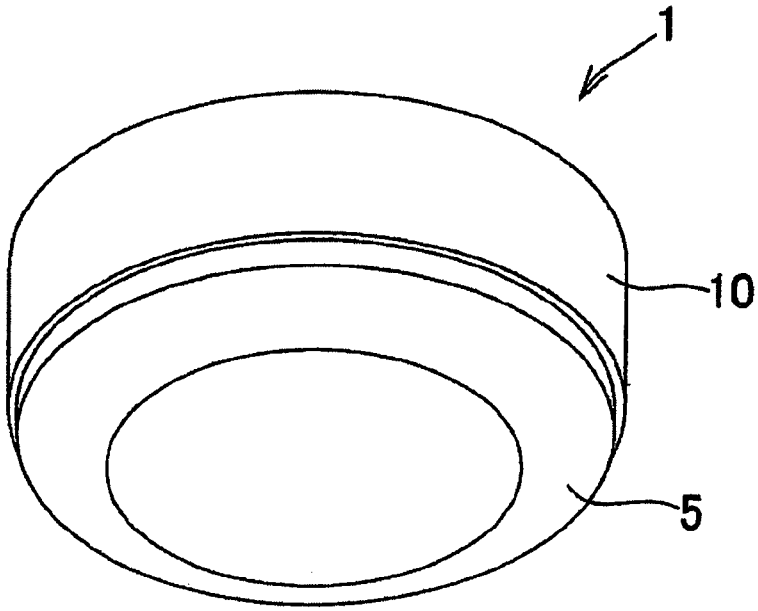
FIG. 2 is a lower perspective view of the same.

Next, an embodiment of the present invention will be described in detail based on the accompanying drawings.

FIGS. 1 to 5 show a bone conduction earphone according to a representative embodiment of the present invention. In the drawings, reference numeral 1 denotes the bone conduction earphone, 2 denotes a voice coil, 3 denotes a vibration part, 4 denotes a cap, and 5 denotes a vibration transmission cushion. The bone conduction earphone 1 of the present invention is configured with a frame 10, the voice coil 2, the vibration part 3, the cap 4, and the vibration transmission cushion 5.

Figure 3:
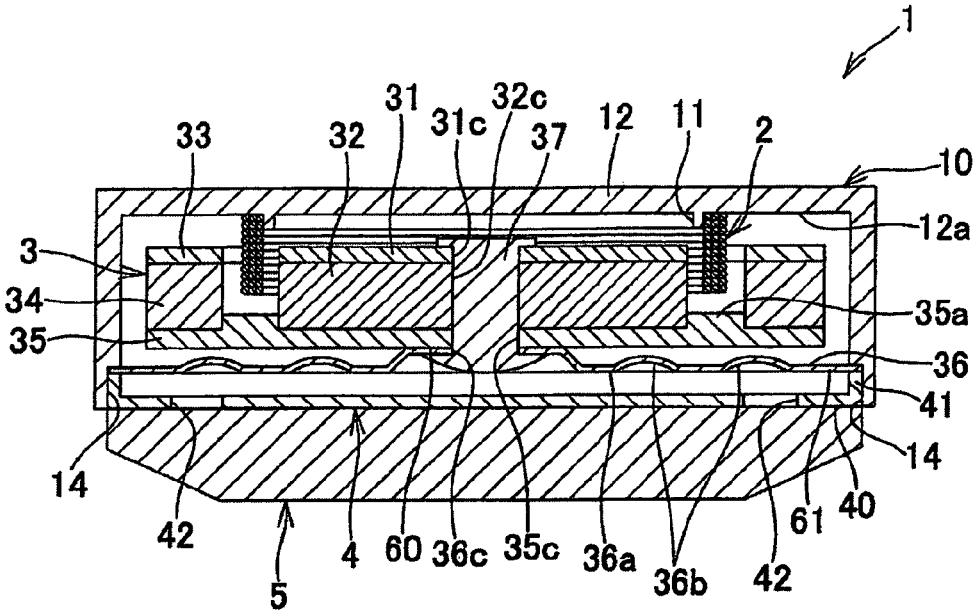
FIG. 3 is a vertical sectional view of the same.
Figure 4:
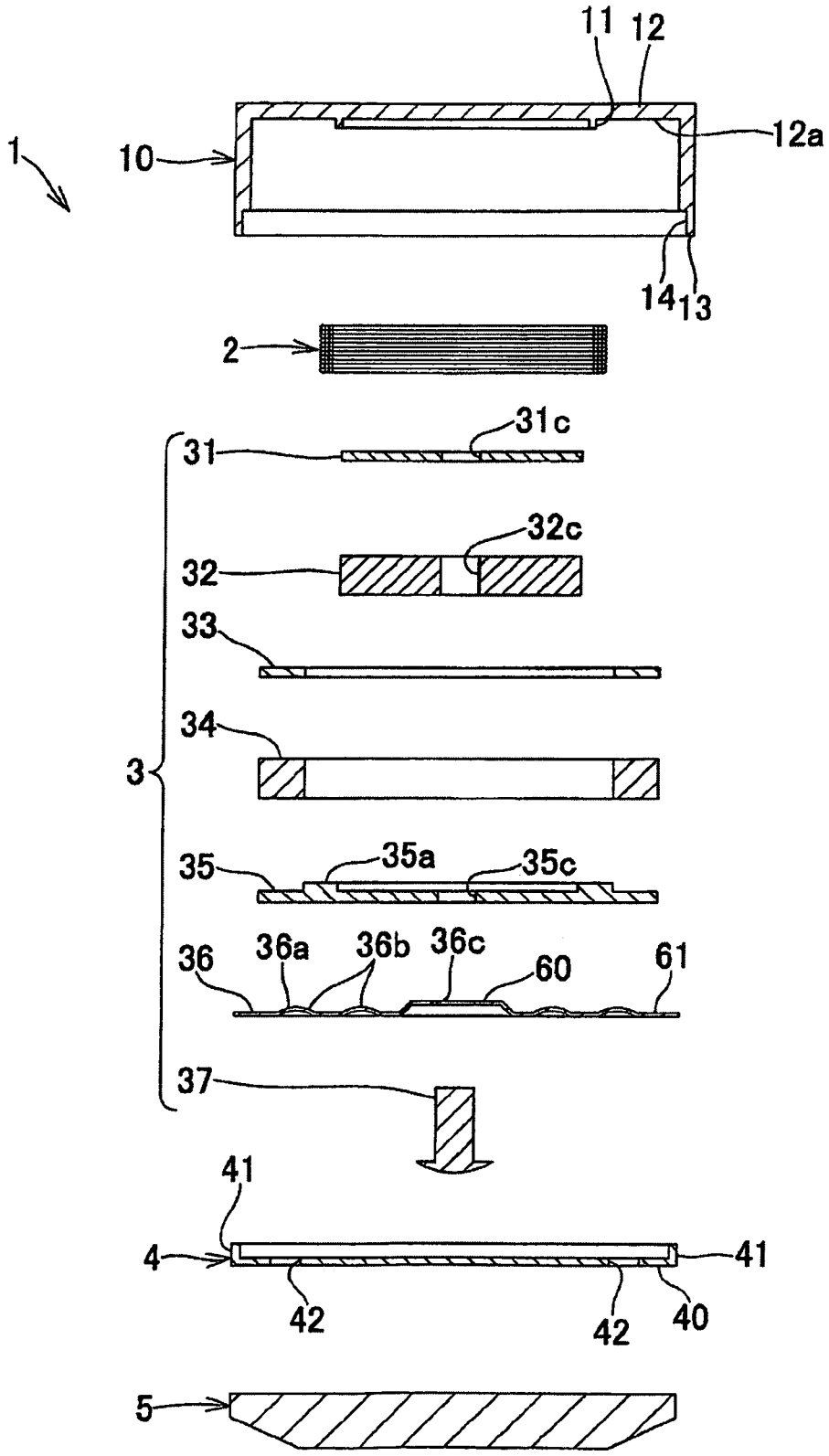
FIG. 4 is an exploded vertical sectional view of the same.
Figure 5:
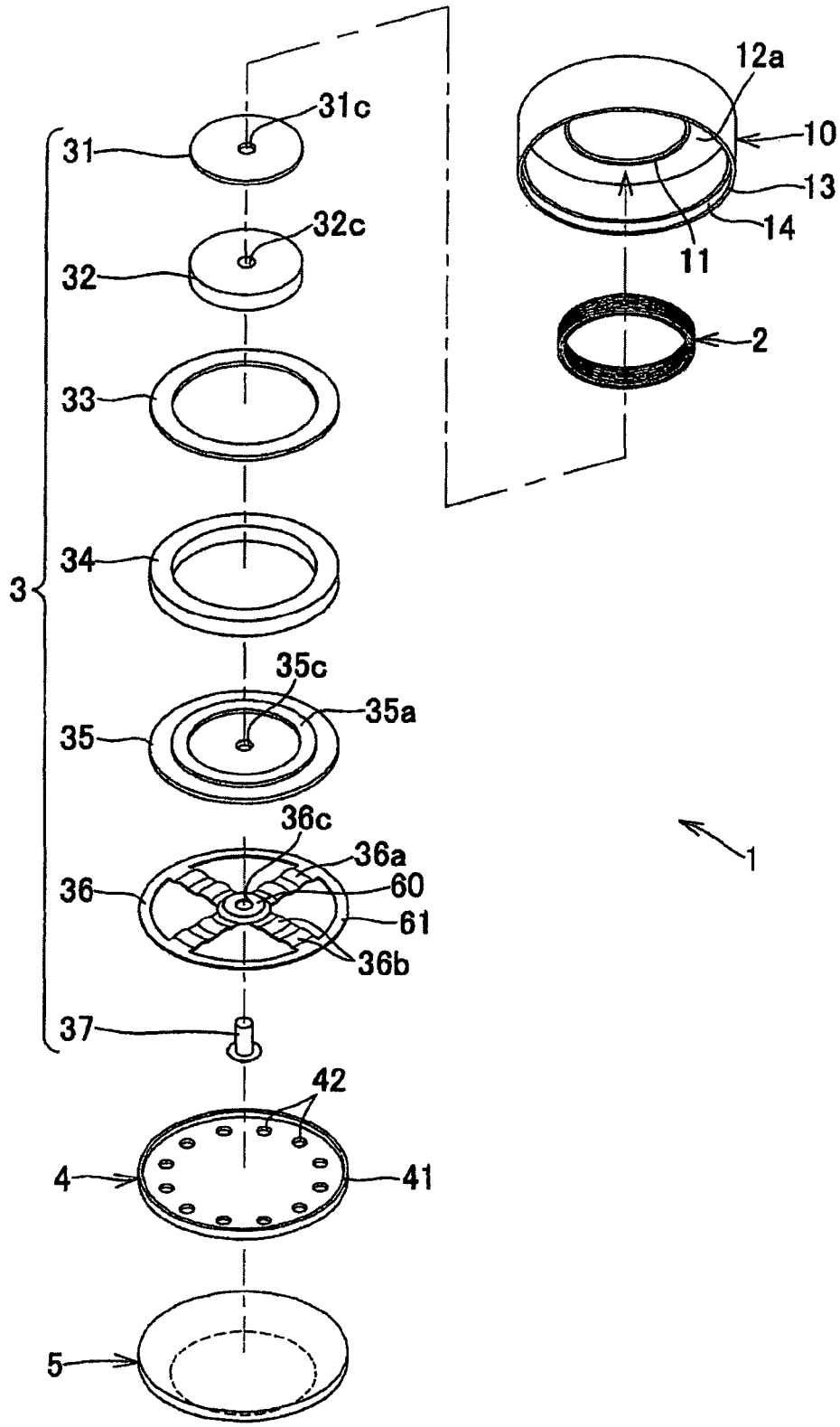
FIG. 5 is an exploded perspective view of the same.

As shown in FIGS. 3 to 5, the bone conduction earphone 1 of the present invention includes the vibration part 3 including a first magnet 32 and a second magnet 34 which coaxially secure the voice coil 2 on an inner surface 12*a* of an upper wall 12 of the cylinder-shaped frame 10 having an open lower part and are located in an inner side region and an outer side region of the voice coil 2, a diaphragm 36 which connects the first magnet 32 and the second magnet 34 to the frame 10, and the vibration transmission cushion 5 provided to the lower part of the frame 10 in order to transmit a vibration of the voice coil 2 and the vibration part 3 to a human body.

The frame 10 has a space therein for storing the voice coil 2 and the vibration part 3. The frame 10 is configured with an approximately cylinder-shaped member which is open downward, and has a lower end opening closed by the cap 4 in a state where the voice coil 2 and the vibration part 3 are stored. The inner surface 12*a* of the frame upper wall 12 is provided with a ring-shaped production part 11 which fits in the voice coil 2 so as to attach the voice coil 2, whereby the voice coil 2 is reliably joined to the inner surface to perform a role of converting an electric signal to an acoustic signal. In this example, the voice coil 2 is formed of a synthetic resin material, but is not limited thereto, and may also be formed of, for example, a nonmagnetic metal material or the like.

The vibration part 3 is configured with the first magnet 32 and the second magnet 34 arranged on an upper surface of a substrate 35 attached on a center of the diaphragm 36 as a yoke, a first plate 31 provided on an upper surface of the first magnet 32, a second plate 33 provided on an upper surface of the second magnet 34, and the voice coil 2 located in a gap between the first and second plates 31 and 33.

The substrate 35 which functions as the yoke is disposed below the voice coil 2 and is a disk-shaped member formed of a magnetic metal material such as iron. On an upper surface of the substrate 35, a ring-shaped protrusion 35*a* is provided in a position corresponding to a lower end of the voice coil 2. The first magnet is bonded to the upper surface on the inner side of the protrusion 35*a* and the second magnet is bonded to the upper surface on the outer side of the protrusion 35*a*, so that the voice coil 2 is sandwiched by the both magnets to be positioned. The height of the protrusion 35*a* is set to a well-balanced height, since a gap with a tip of the voice coil 2 particularly influences a magnetic circuit.

The first magnet 32 is a permanent magnet formed in a flat circular column shape. On an upper surface of the first magnet 32, a lower surface of the first plate 31 having approximately the same shape with the first magnet 32 is adhered. The first plate 31 is formed of a magnetic metal material such as iron, and functions as a pole piece to generate a strong magnetic field in a gap with the second plate 33 described later.

The second magnet 34 is a permanent magnet formed in a flat circular column shape (ring shape) having approximately the same height as that of the first magnet 32, and constitutes the magnetic circuit together with the first magnet 32. On an upper surface of the second magnet 34, a lower surface of the second plate 33 having approximately the same shape with the second magnet 34 is bonded in a cohesive state. The second plate 33 is formed of a magnetic metal material such as iron, and is a member functioning as a top plate to generate a strong magnetic field in the gap with the first plate 31.

Through holes 36*c*, 35*c*, 32*c*, and 31*c* continuous with each other are provided in the respective center positions of the diaphragm 36, the substrate 35, the first magnet 32, and the first plate 31, and the respective members 36, 35, 32, and 31 are integrally connected coaxially by a securing pin 37 penetrating the through holes 36*c*, 35*c*, 32*c*, and 31*c*. A caulking pin which vertically penetrates and caulks the members is used as the securing pin 37, but a bolt nut or other connecting tools may also be used.

The diaphragm 36 is attached to the lower surface of the substrate 35. The diaphragm 36 is configured with a center part 60 including the through hole 36*c*, a peripheral part 61 attached to the frame 10, and a plurality of connection parts 36*a* provided radially between the center part 60 and the peripheral part 61. The connection parts 36*a* are respectively formed with bend parts 36*b* which are bended in a crinkled or wrinkled manner. In this example, a total of four connection parts 36*a* are provided at 90° intervals. However, the number and arrangement relations are not particularly limited, and it is needless to say that the widths of the respective connection parts are also not limited. A number of the crinkled and wrinkled bend parts 36*b* are formed in the respective connection parts 36*a*, whereby the surface area involved with the vibration of the diaphragm 36 is maximized.

The cap 4 which closes the lower part of the frame 10 is provided in a state where the cap 4 is in contact with the diaphragm 36 to be connected to the frame 10, and the vibration transmission cushion 5 is provided on a lower surface 40 of the cap 4. More specifically, a cutout groove 14 is provided around the inner circumference side of a lower part opening 13 of the frame 10. In a state where the peripheral part 61 of the diaphragm 36 is engaged with the cutout groove 14, further engaging a projection part 41 provided along the periphery of the cap 4 on the lower surface side thereof allows the peripheral part 61 of the diaphragm 36 to be secured in a pressed state within the cutout groove 14 of the frame 10 by the projection part 41 of the cap 4.

As shown in FIG. 5, the cap 4 is formed with a number of through holes 42 along the circumferential direction, and is created to be capable of transmitting air vibration generated in a space within the frame 10 to the vibration transmission cushion 5 on the lower surface side via the through holes 42. The vibration transmission cushion 5 is adhered to the lower part of the cap 4, whereby the vibration generated from the voice coil 2 and the vibration part 3 is efficiently transmitted to the human body.

The operation of the bone conduction earphone 1 of the present invention will be described below.

First, an electric signal relating to sound is supplied to the voice coil 2 via a lead wire (not shown), whereby a magnetic field proportional to the strength of the transmitted electric signal is formed inside and outside the voice coil 2. The magnetic field interacts with first magnet 32 and the second magnet 34 of the vibration part 3, i.e., interacts with a magnetic field generated in the gap between the first plate 31 and the second plate 33, whereby the voice coil 2 and the vibration part 3 relatively vibrate vertically in a predetermined frequency.

When the vibration part 3 vibrates vertically with respect to the voice coil 2 in the predetermined frequency as described above, the vibration is immediately transmitted to the diaphragm 36 including the connection parts 36*a* and the crinkled and wrinkled bend parts 36*b*. At this time, since a number of the bend parts 36*b* which improve vibration efficiency are formed in the diaphragm 36 as described above, the vibration of the vibration part 3 caused by the magnets 32 and 34 is considerably amplified by the diaphragm 36 to be outputted.

The vibration outputted from the diaphragm 36 is transmitted to the human body via the cap 4 and the vibration transmission cushion 5, whereby the human body can recognize a predetermined acoustic signal.

The embodiment of the present invention has been described above, but the present invention is not limited to the example described above, and it is needless to say that embodiments in various forms are possible without departing from the gist of the present invention.

What is claimed is:

1. A bone conduction earphone comprising:

a vibration part including;

a first magnet and a second magnet, each formed in a flat circular column shape, coaxially securing a voice coil on an inner surface of an upper wall of a cylinder-shaped frame having an open lower part, the first magnet located in an inner side region and the second magnet located on an outer side region of the voice coil; and a diaphragm connecting the first magnet and the second magnet to the frame; and a vibration transmission cushion provided to the lower part of the frame in order to transmit a vibration of the voice coil and the vibration part to a human body.

2. The bone conduction earphone according to claim 1, further comprising a cap closing the lower part of the frame in a state where the cap is in contact with the diaphragm to be connected to the frame, wherein, the vibration transmission cushion is provided on a lower surface of the cap.

3. A bone conduction earphone comprising:

a vibration part including;

a first magnet and a second magnet coaxially securing a voice coil on an inner surface of an upper wall of a cylinder-shaped frame having an open lower part and located in an inner side region and an outer side region of the voice coil;

a diaphragm connecting the first magnet and the second magnet to the frame; and a vibration transmission cushion provided to the lower part of the frame in order to transmit a vibration of the voice coil and the vibration part to a human body, wherein the vibration part is formed of the first magnet and the second magnet arranged on an upper surface of a substrate attached on a center of the diaphragm as a yoke, a first plate provided on an upper surface of the first magnet, a second plate provided on an upper surface of the second magnet, and the voice coil located in a gap between the first and second plates.

4. The bone conduction earphone according to claim 3, further comprising through holes continuous with each other in respective center positions of the diaphragm, the substrate, the first magnet, and the first plate, wherein the respective members are integrally connected by a securing pin penetrating the through holes.

5. The bone conduction earphone according to claim 4, wherein:

the diaphragm is configured with a center part attached to the substrate, a peripheral part attached to the frame, and a plurality of connection parts provided radially between the center part and the peripheral part; and the connection part is formed with a bend part bended in a crinkled or wrinkled manner.

6. The bone conduction earphone according to claim 5, further comprising a cap closing the lower part of the frame in a state where the cap is in contact with the diaphragm to be connected to the frame, wherein, the vibration transmission cushion is provided on a lower surface of the cap.

7. The bone conduction earphone according to claim 5, further comprising a cap closing the lower part of the frame in a state where the cap is in contact with the diaphragm to be connected to the frame, wherein, the vibration transmission cushion is provided on a lower surface of the cap.

8. The bone conduction earphone according to claim 3, wherein:

the diaphragm is configured with a center part attached to the substrate, a peripheral part attached to the frame, and a plurality of connection parts provided radially between the center part and the peripheral part; and the connection part is formed with a bend part bended in a crinkled or wrinkled manner.

9. The bone conduction earphone according to claim 8, further comprising a cap closing the lower part of the frame in a state where the cap is in contact with the diaphragm to be connected to the frame, wherein, the vibration transmission cushion is provided on a lower surface of the cap.

10. The bone conduction earphone according to claim 3, further comprising a cap closing the lower part of the frame in a state where the cap is in contact with the diaphragm to be connected to the frame, wherein, the vibration transmission cushion is provided on a lower surface of the cap.

11. A bone conduction earphone comprising a vibration part including;

a first magnet and a second magnet coaxially securing a voice coil on an inner surface of an upper wall of a cylinder-shaped frame having an open lower part and located in an inner side region and an outer side region of the voice coil; and a diaphragm connecting the first magnet and the second magnet to the frame; and a vibration transmission cushion provided to the lower part of the frame in order to transmit a vibration of the voice coil and the vibration part to a human body, wherein:

the diaphragm is configured with a center part attached to a substrate, a peripheral part attached to the frame, and a plurality of connection parts provided radially between the center part and the peripheral part; and the connection part is formed with a bend part bended in a crinkled or wrinkled manner.

12. The bone conduction earphone according to claim 11, further comprising a cap closing the lower part of the frame in a state where the cap is in contact with the diaphragm to be connected to the frame, wherein, the vibration transmission cushion is provided on a lower surface of the cap.

* * * * *